US006056421A

United States Patent [19]

Johnson

[11] Patent Number: 6,056,421

[45] **Date of Patent: *May 2, 2000**

[54] ARCHITECTURAL LIGHTING DEVICES WITH PHOTOSENSITIVE LENS

[75] Inventor: Michael Brian Johnson, 40 Jerome Ave., Bloomfield, Conn. 06002

[73] Assignee: Michael Brian Johnson, Bloomfield, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/519,200

[22] Filed: Aug. 25, 1995

[51] Int. Cl.[7] ..... F21V 9/00

[52] U.S. Cl. ..... 362/293; 362/255; 313/112; 313/479

[58] Field of Search ..... 362/276, 293, 362/802, 147, 226, 260, 84, 255, 256, 1, 2; 359/241, 243; 252/586; 313/112, 117, 478, 479

[56] References Cited

U.S. PATENT DOCUMENTS

| | | | |
|---|---|---|---|
| 3,911,315 | 10/1975 | Todd, Jr. et al. | 313/391 |
| 4,576,766 | 3/1986 | Baskerville et al. | 359/241 |
| 4,688,154 | 8/1987 | Nilssen | 362/147 |
| 4,766,526 | 8/1988 | Morimoto et al. | 362/255 |
| 4,909,963 | 3/1990 | Kwak et al. | 359/241 |
| 4,929,865 | 5/1990 | Blum | 313/478 |
| 4,954,937 | 9/1990 | Kobayashi et al. | 362/255 |
| 4,994,208 | 2/1991 | McBain et al. | 359/241 |
| 5,055,982 | 10/1991 | Johnson | 362/61 |
| 5,143,438 | 9/1992 | Giddens et al. | 362/84 |
| 5,228,767 | 7/1993 | Johnson | 362/276 |

*Primary Examiner*—Alan Cariaso
*Attorney, Agent, or Firm*—Bryan Cave LLP

[57] ABSTRACT

An interior or exterior design lighting assembly with a photosensitive sheet member in spaced relation to said assembly capable of aesthetically concealing its inner componentry by having said photosensitive sheet member adapting a darkened appearance when said assembly is in its de-energized state. When the light assembly is energized said photosensitive sheet member will render its darkened state to adapt a transparent state allowing for full light transmission to occur.

13 Claims, 4 Drawing Sheets

ARCHITECTURAL LIGHTING DEVICES WITH PHOTOSENSITIVE LENS

BACKGROUND OF THE INVENTION

Lighting fixtures currently in use in residential, industrial, outdoor or other architectural applications typically utilize clear or frosted lenses to cover the orifice of the lighting fixture to primarily serve as both a safety shield for the inner light source and its related componentry and as a means to pitch light rays in a predetermined direction throughout a given area.

However, the clear lenses suffer from the inability of aesthetically being able to conceal the inner componentry of the light source, thus limiting the lighting fixture's aesthetic appeal in certain design environments. In the case of frosted lenses they do effectively conceal the inner componentry of the lighting fixture, but however achieves its objectives by placing only one type of conventional "white-haze" coating over the lens.

In addition, there are some light bulbs that have colored glass housings surrounding their filaments which cast a functional red, blue, yellow, etc. light when said light source is activated.

However, when said source is not activated this permanent glass tint is unable to alter its functional coloration to that of another coloration (or transparent) to better suit its interior or exterior design environments.

SUMMARY OF THE INVENTION

The invention relates to general interior and exterior design lighting assembly devices with a conventional lighting source which will be coupled with a photosensitive lens sheet member capable of changing to a desired colored state when said source is deactivated and when activated changes to a clear state.

As depicted in my prior U.S. Pat. Nos. 5,055,982 and 5,228,767 an external headlight cover and headlamp lens, respectively, is provided on a vehicle, where the disclosure of these patents are incorporated by reference herein. The present invention deals with a lighting fixture that is provided with a lens portion having the characteristics of the cover and lens disclosed in my prior patents.

DETAILED DESCRIPTION

Figure 1:
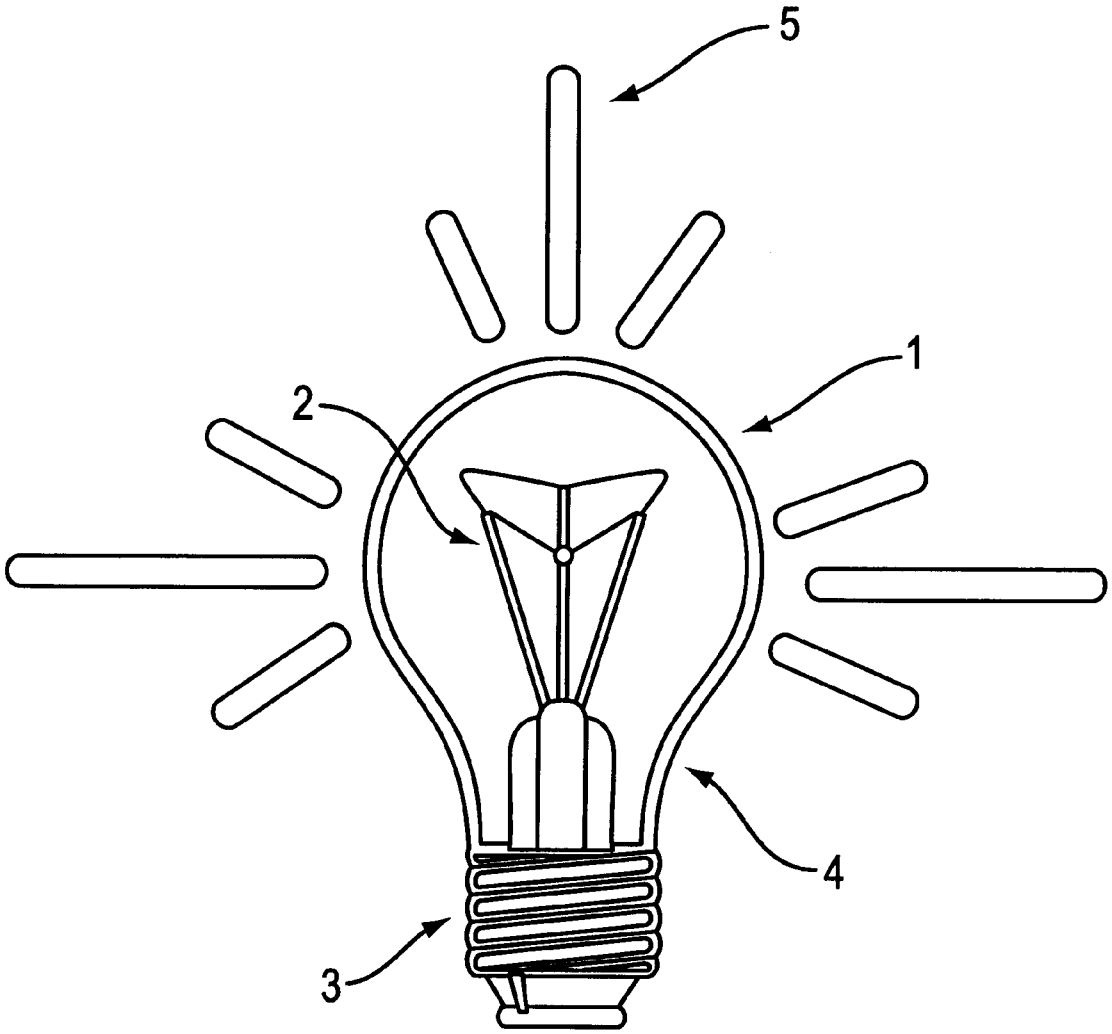
FIG. 1 is a view showing an embodiment of the present invention in the form of a light bulb while in an energized state with a transparent glass housing.
Figure 2:
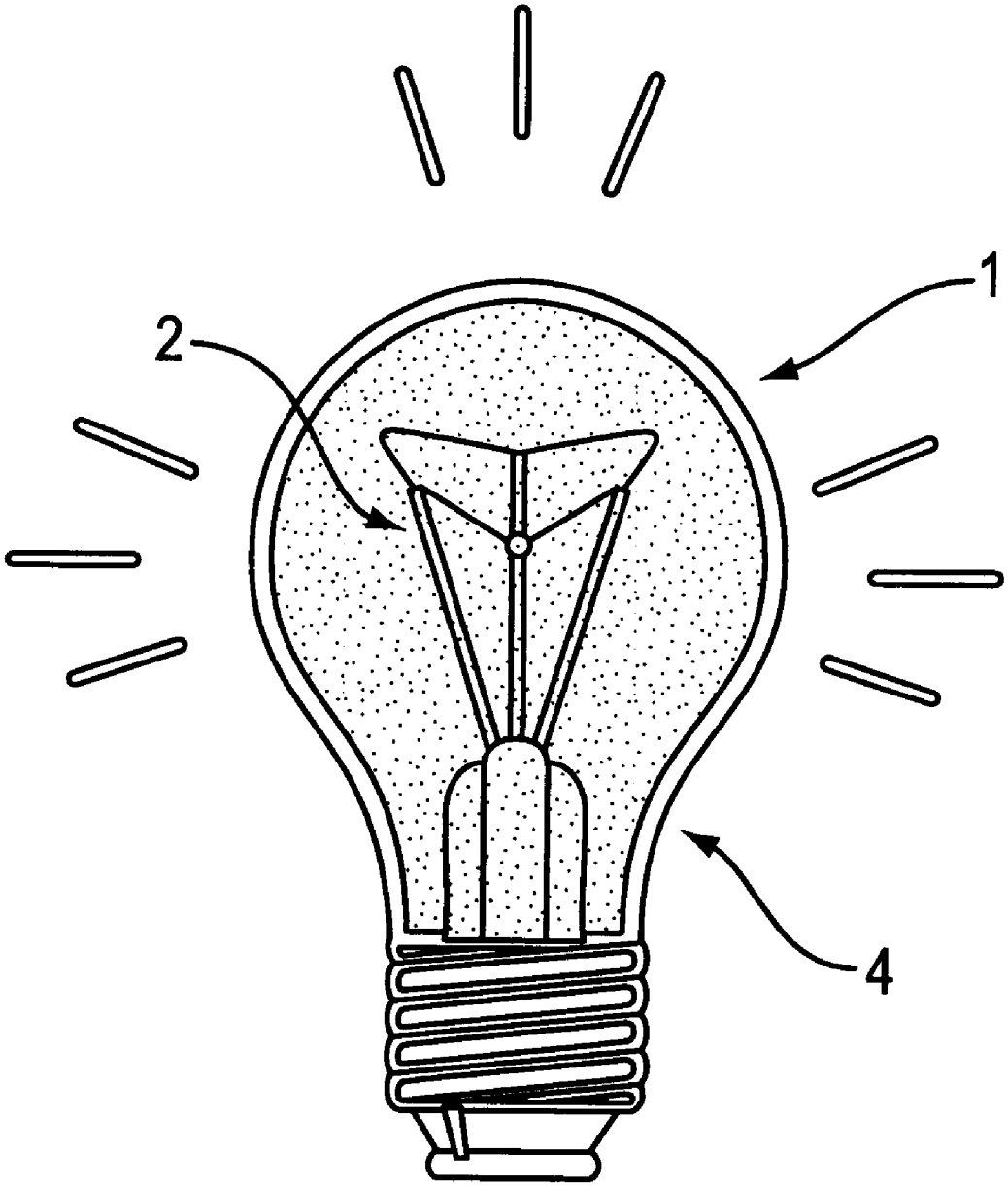
FIG. 2 is another view showing an embodiment of the present invention in the form of a light bulb while in an energized state with a partially darkened glass housing.
Figure 3:
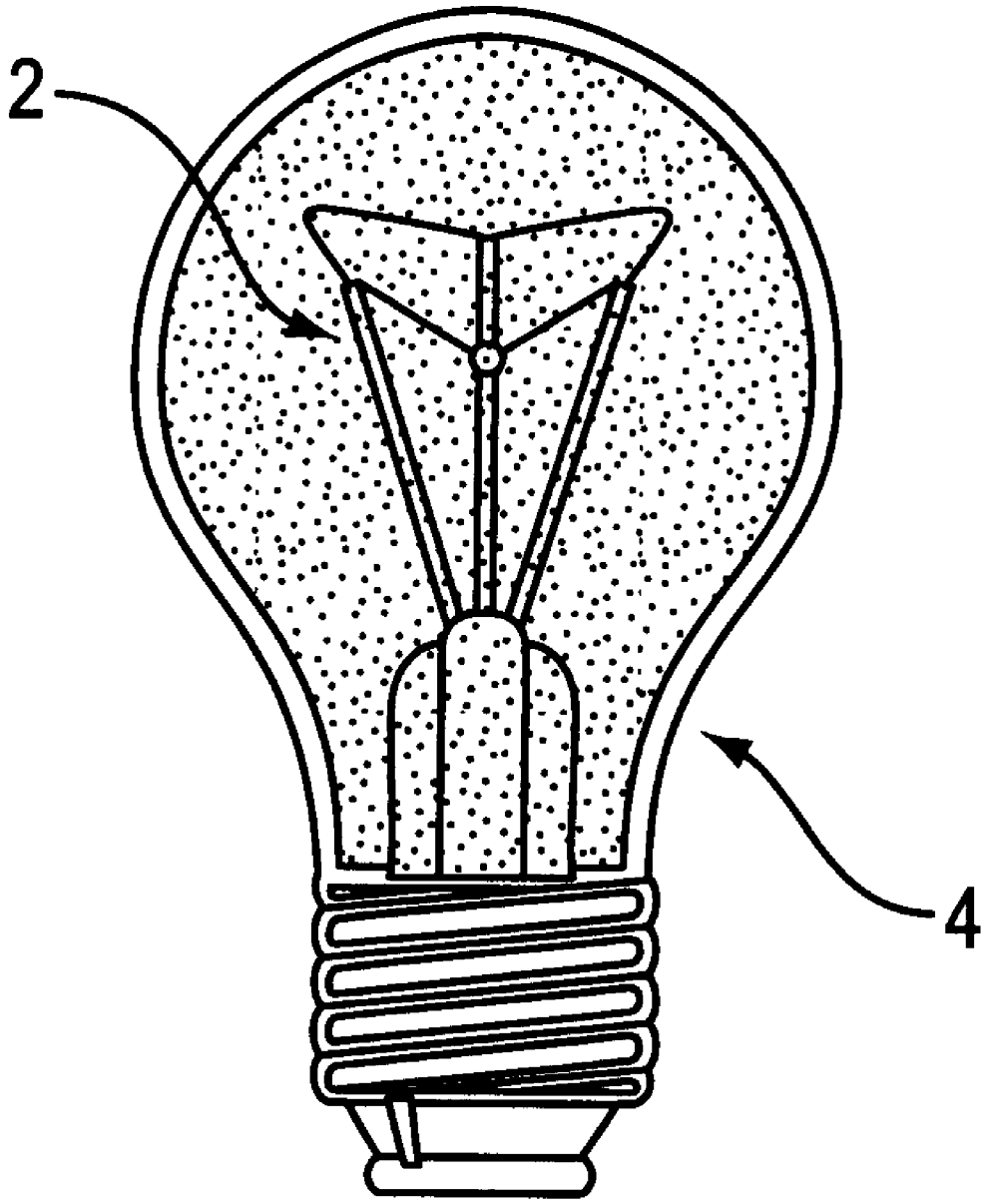
FIG. 3 is a view showing another embodiment of the present invention in the form of a light bulb while in a non-energized state with a fully darkened glass housing.

In FIGS. 1, 2 and 3, an embodiment of the invention is shown where the light source is in the form of a light bulb 1. The light bulb 1 will comprise of a lighting element, filament 2, interconnected to a socket connector 3 which will be enclosed by a glass housing 4.

Figure 4:
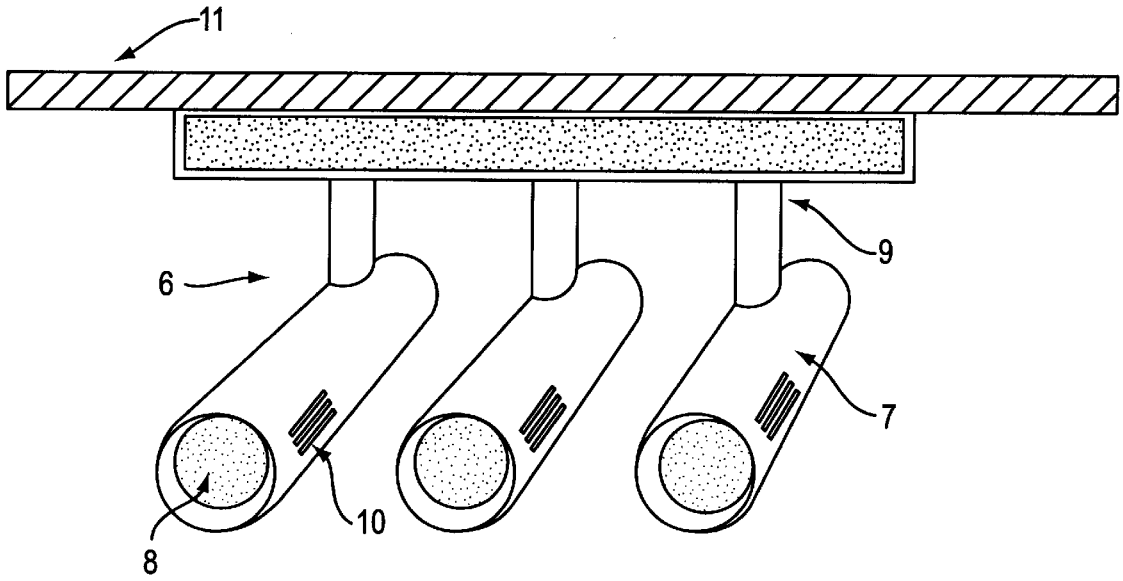
FIG. 4 shows in perspective view a light assembly in a conventional track light fixture connected in a ceiling position whereby the lens portion of the said fixture is constructed in accordance to the present invention.

The socket connector 3 will serve as the light bulb's 1 electrical interface with a compatible lighting fixture 6 as depicted in FIG. 4.

More descriptively, turning to FIG. 3, when the said invention's filament 2 is in a non-energized state the glass housing 4 will be of a darkened coloration or of an opaque/semi-opaque nature such as a grey, green, orange etc. when an activation source such as ultra-violet rays is applied to the glass housing 4.

Turning to FIG. 2, when the said light bulb 1 is switched to its energized state, its filament 2 will emit light rays 5 which will begin to permeate the glass housing 4 resulting in the darkened coloration of the glass housing 4 to metamorphically begin becoming clearer.

In FIG. 1, over a given time period, the fully energized filament 2 will drive the glass housing 4 from its darkened state to a transparent state, by way of its light rays' 5 infrared energy, thus yielding optimal light exposure.

Referring to FIG. 4, this invention will also relate to general lighting fixtures found in interior and exterior design lighting applications. In this embodiment of the invention a lighting fixture 6 is illustrated serving as a track light assembly comprising of a lighting canister 7 which has side vents 10 that is connected to a room's ceiling 11 by way of a mounting apparatus 9.

The lighting canister 7 will house the lighting source (not shown) such as a light bulb 1 in FIG. 1 or conventional light bulb where it will be connected into the lighting fixture's electrical socket (not shown).

In accordance with the present invention the lighting fixture 6 further includes a lens 8 which is mounted over the lighting canister's 7 orifice. The lens 8 is fabricated from a photosensitive glass, namely a photochromic glass substrate. This technology will give the lens 8 the ability to change its aesthetic characteristics upon exposure to certain types of light sources or/and electromagnetic radiation energies.

More specifically, the lens 8 of the lighting fixture 6 will be in a fully or partially transparent phase when the light source is in its energized state, however when the light source is in a non-energized state the lens 8 will transform to a predetermined coloration over a given period of time or instantaneously. This transformation in coloration will be executed in the same manner as the light bulb's glass housing 4 in FIGS. 1 through 3 illustrated.

The excitation and fade time elapsed will be of a reversible nature and can be dictated over a predetermined time period depending upon such characteristics as: chemical properties of the photosensitive glass, the intensity of the light rays, energy's wavelength, thickness of glass, temperature of glass, etc.

The glass housing and lens mentioned in the above invention will be constructed in accordance to current photosensitive technology. The actual technology is not presented in detailed disclosure, but the applicant notes that the present technology provides for different colorations depending upon the introduction of specific chemical additive mixtures of dopants, dyes and/or colorants into the raw material during the fabrication process of the glass or plastic resin substrate.

I claim:

1. A photosensitive interior lighting fixture which comprises:

a light source;

a housing supporting the light source; and a photosensitive layer at least partially covering the light source, wherein the photosensitive layer is in a low transmittance state under ambient interior lighting conditions and becomes transparent upon illumination of the light source.

2. The photosensitive interior lighting fixture according to claim 1 wherein the photosensitive layer is color pigmented in the low transmittance state.

3. The photosensitive interior lighting fixture according to claim 1 wherein the low transmittance state is a colored appearance.

4. The photosensitive interior lighting fixture according to claim 1 wherein the photosensitive layer comprises a photochromic material.

5. The photosensitive interior lighting fixture according to claim 1 wherein the photosensitive layer changes from the low transmittance state to transparent as a result of infrared or electromagnetic radiation from the light source.

6. A photosensitive lighting fixture for mounting to a non-moving structure and for attachment to a source of power, the lighting fixture comprising:

a light source connected to the source of power;

a housing supporting the light source;

means for mounting the housing to the non-moving structure; and a photosensitive layer at least partially covering the light source, wherein the photosensitive layer is in a low transmittance state under a first type of lighting condition and becomes transparent under a second type of lighting condition.

7. The photosensitive lighting fixture according to claim 6 wherein the first type of lighting condition is ultra-violet rays.

8. The photosensitive lighting fixture according to claim 7 wherein the low transmittance state is a colored appearance.

9. The photosensitive lighting fixture according to claim 6 wherein the photosensitive layer comprises a photochromic material.

10. The photosensitive lighting fixture according to claim 6 wherein the second type of lighting condition is light emitted from the light source.

11. The photosensitive lighting fixture according to claim 6 wherein the housing is a track light fixture.

12. A photosensitive lighting fixture which comprises:

a light source;

a housing supporting the light source; and a photosensitive layer at least partially covering the light source, wherein the photosensitive layer is in a low transmittance state under a first type of lighting condition and becomes transparent upon illumination of the light source due to the emission of electromagnetic radiation from the light source.

13. The photosensitive lighting fixture according to claim 12 wherein the low transmittance state is a colored appearance.

* * * * *